US005173057A

United States Patent [19]

Bunch et al.

[11] Patent Number: 5,173,057

[45] Date of Patent: Dec. 22, 1992

[54] PERMANENT PROTECTIVE COVER

[75] Inventors: Ricky L. Bunch, Tecumseh; Anthony S. Carstensen, Adrian, both of Mich.

[73] Assignee: Tecumseh Products Company, Tecumseh, Mich.

[21] Appl. No.: 832,378

[22] Filed: Feb. 7, 1992

[51] Int. Cl.[5] ..... H01R 13/00

[52] U.S. Cl. ..... 439/217; 439/685

[58] Field of Search ..... 439/638, 639, 641, 656, 439/685, 689, 690, 217

[56] References Cited

U.S. PATENT DOCUMENTS

| | | | |
|---|---|---|---|
| 2,590,559 | 3/1952 | Miller | 171/252 |
| 2,728,060 | 12/1955 | Doeg | 439/685 |
| 2,800,525 | 7/1957 | Kain | 174/138 |
| 3,160,460 | 12/1964 | Wyzenbeek | 439/685 |
| 3,657,503 | 4/1972 | Smith | 200/42 |
| 3,960,427 | 6/1976 | Piaget | 339/39 |
| 4,109,992 | 8/1978 | Hughes et al. | 439/685 |
| 4,415,044 | 11/1983 | Davis | 174/138 |
| 4,640,985 | 2/1987 | Martin | 174/138 |
| 4,969,832 | 11/1990 | Fry | 439/92 |

*Primary Examiner*—Joseph H. McGlynn
*Attorney, Agent, or Firm*—Baker & Daniels

[57] ABSTRACT

A hermetic compressor with a permanent protective cover assembly including a protective cover, fastener means attaching the protective cover to the compressor housing over a hermetic terminal, and concealment means for preventing field technicians from viewing the fastener means and uncovering the hermetic terminal. The concealment means includes a cap that fits flush with the front face of protective cover over the fastener means. A terminal strip on the protective cover is in electrical connection to the covered hermetic terminal thereby eliminating the necessity to remove the protective cover during field service.

18 Claims, 2 Drawing Sheets

PERMANENT PROTECTIVE COVER

BACKGROUND OF THE INVENTION

The present invention relates generally to hermetic compressors of the type having a hermetic housing wherein a hermetic terminal cluster is provided for carrying electric current into the housing and, more particularly, to such a terminal cluster having a permanent protective cover.

Methods for enclosing the terminal cluster include providing an upwardly extending fence around the hermetic terminal cluster. Such a wall generally comprises a formed piece of metal welded to the exterior wall of the pressure housing thereby leaving an access opening which must then be covered with a combination cover piece and retaining clip. Another protective cover design employs a cover member received on a threaded stud welded to the compressor housing in close proximity to the hermetic terminal cluster and retained thereon by a threaded nut or the like.

A present method for testing the continuity of the internal compressor wiring may result in the protective cover being removed to enable an electrical connection to be made to the compressor terminals.

It is desired to provide a permanent protective cover effective in preventing access to the hermetic terminal during servicing of the compressor while allowing field access to the wiring connections.

SUMMARY OF THE INVENTION

The present invention overcomes the problems of the above described prior art terminal shields by providing a permanent protective cover capable of preventing access to the hermetic terminal on a hermetic compressor while allowing field access to the wiring connections.

Generally, the invention provides a protective cover assembly for use as a hermetic terminal cover on a hermetic compressor. The assembly includes a protective cover having a terminal strip on a front face. The rear face of the cover includes a recess that encloses the hermetic terminal cluster. A hermetic terminal cluster connector is disposed within the recess for electrically connecting the terminal cluster to the terminal strip thereby permitting electrical power to be supplied to a covered hermetic terminal cluster. A fastener attaches the protective cover to the hermetic compressor while a concealment means is provided for concealing the fastener from view to prevent field access to the hermetic terminal cluster.

In one form of the invention, the fastener includes a nut engaged onto a stud, welded to the compressor, and disposed through the protective cover. Accordingly, other fasteners may be used to attach the protective cover to the compressor housing.

In one form of the invention, the concealment means is a cap having a top face whereby the cap covers the fastener means such that the cap top face is even and flush with the front face of the protective cover. Accordingly, no access to the fastener is evident to field technicians servicing the compressor. The concealment cap also prohibits access to the protective cover fastener.

An advantage of the permanent protective cover assembly of the present invention is that the hermetic terminal area will never be exposed when service work is performed on the compressor since all electrical connections needed take place on the terminal strip on the protective cover.

Another advantage of the protective cover assembly of the present invention according to one form thereof is that of concealing the fastening method attaching the protective cover to the compressor thereby reducing attempts of service technicians to remove the protective cover from the hermetic terminal cluster.

A further advantage of the permanent protective cove of the present invention is the provision of a simple, reliable and easily manufactured permanent hermetic terminal cover mechanism for enclosing hermetic terminal clusters.

Yet another advantage of the protective cover of the present invention is that of enabling temporary electrical hook ups and testing by the compressor manufacturer and field service personnel without exposing the hermetic terminal cluster.

The invention, in form thereof, provides a hermetic compressor including a housing and hermetic terminal with a protective cover assembly. The assembly includes a protective cover attached by a fastener to the housing with a recess for enclosing the hermetic terminal cluster. Terminal means such as a terminal strip is located on the protective cover for connecting power to the hermetic terminal cluster. Within the protective cover, a connection means is disposed for electrically connecting the terminal means to the hermetic terminal cluster. The hermetic terminal cluster is thereby enclosed at all times while electrical connection to the hermetic terminal cluster is permitted.

In one aspect of the previously described form of the invention, the protective cover assembly further includes a concealing means for concealing the fasteners from view. Concealment is provided by a cap having a top face such that when the cap covers the fastener, the top face is flush with the protective cover. The cap may attach to either the fastener or directly to the protective cover.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
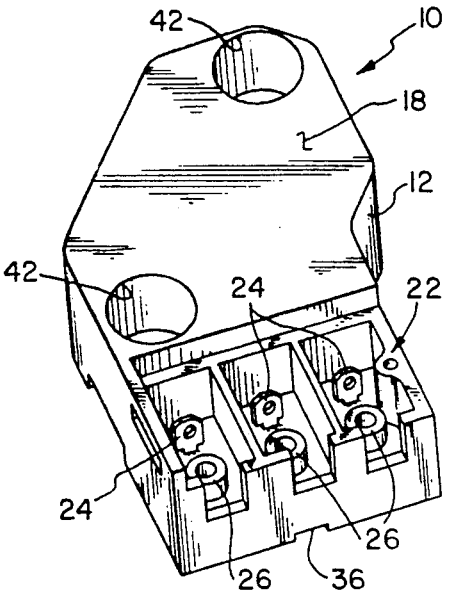
FIG. 1 is a perspective view of the permanent protective cover assembly of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 2:
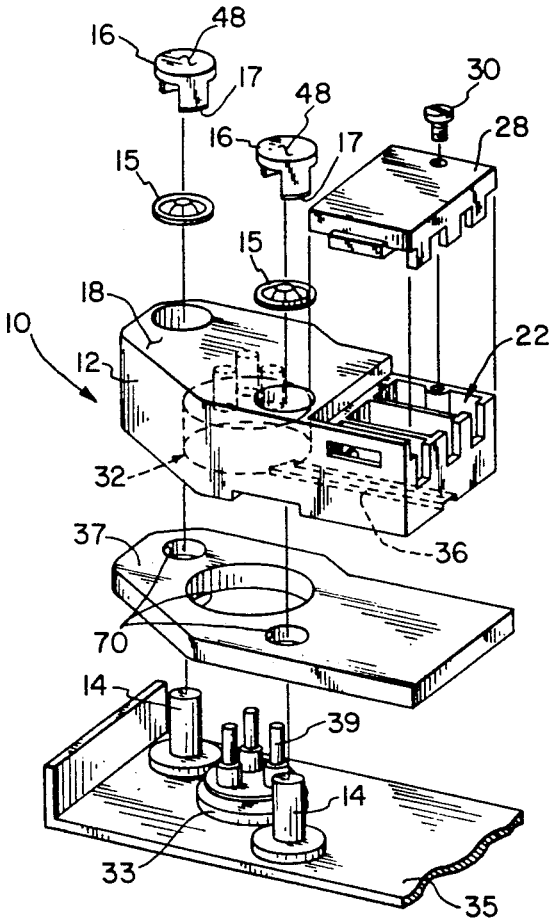
FIG. 2 is a blow-up of the permanent protective cover of the present invention shown in conjunction with a hermetic terminal.

Referring now to FIGS. 1 and 2, there is shown the permanent protective cover assembly 10 of the present invention. Assembly 10 comprises a protective cover 12, fastener means such as stud 14 and push nut 15, and a fastener concealment means such as cap 16. Stud 13 is welded to compressor housing 35.

Figure 4:
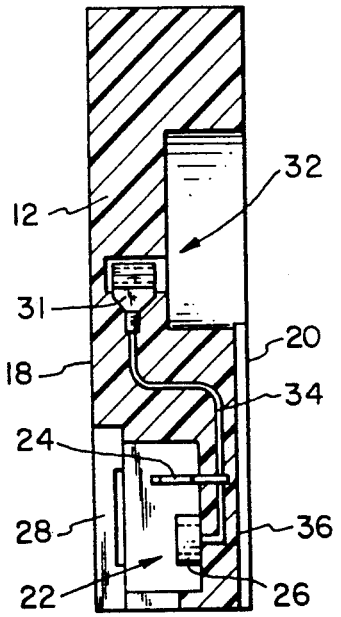
FIG. 4 is a sectional view of the permanent protective cover of FIG. 1, taken along line 4—4 in FIG. 3 and viewed in the direction of the arrows.

Protective cover 12 is constructed of molded plastic having a front face 18 and rear face 20 (FIG. 4). A terminal means such as terminal strip 22 is disposed in front face 18. As shown in FIG. 1, strip 22 has a plurality of male quick connect terminals 24 and screw type terminals 26. A terminal cover 28 is adapted to attach to protective cover 12 over terminal strip 22 by means of at least one terminal cover screw 30.

Along rear face 20 of protective cover 12, a recess 32 is disposed for enclosing terminal cluster 33. Recess 32 permits protective cover 12 to seal tightly to compressor housing 35 when attached.

A hermetic terminal connector 31 is disposed within recess 32 for attachment to pins 39 of a hermetic terminal cluster 33 having pins 39 as shown in FIG. 4. FIG. 2 shows hermetic terminal 33 disposed within a part of housing 35 of a hermetic compressor. A connection means, such as connector wires 34, is disposed within the body of cover 12 for electrically connecting terminals 24 and 26 to hermetic terminal connector 31 (FIG. 4). The connection means 34 may be either soldered or crimped to connector 31 and used to connect terminals 24 and 26 to hermetic terminal pins 39. Alternatively, connection means 34 may be integrally manufactured with connector 31. Subsequent reference to connector wires 34 is to mean all forms of making the connection between terminals 24 and 26 and hermetic terminal pins 39.

The provision of an electrical connection through the protective cover 12 via the terminal connectors 31, connector wires 34 and terminal strip 22 permits electrical connection to the hermetic terminal cluster 33 by service personnel without the need to remove protective cover 12 from compressor housing 35.

As shown in FIG. 2, permanent protective cover assembly 10 includes a gasket 37 preferably made out of neoprene to seal cover 12 to housing 35. Gasket 37 includes openings 70 that seal with hermetic terminal 33 and studs 14. Gasket 37 may be made out of rubber or other gasket materials. Protective cover 12 includes a vent passage 36 along rear face 20.

Figure 3:
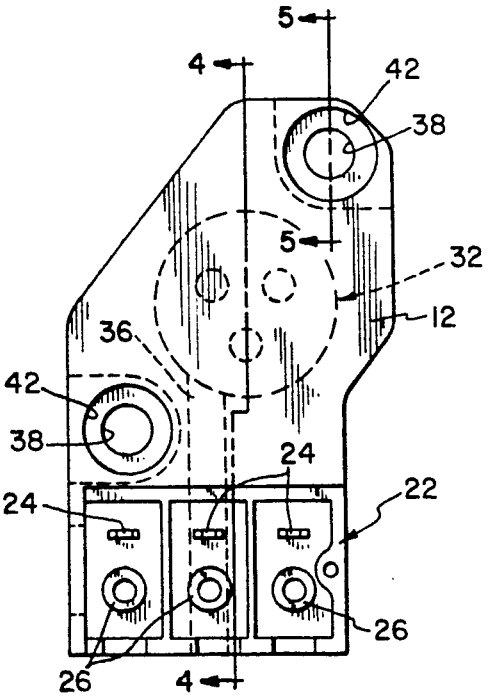
FIG. 3 is a plan view of the permanent protective cover of the present invention.
Figure 5:
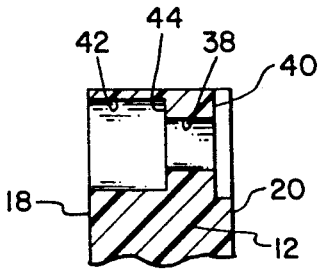
FIG. 5 is an enlarged fragmentary sectional view of the fastener passageway of FIG. 3 taken along line 5—5 in FIG. 3 and viewed in the direction of the arrows.

FIGS. 3 and 5 show fastener passages 38 through protective cover 12. A counterbore section 40 along rear face 20 permits engagement of cover 12 with stud 14. An upper counterbore 42 creates room for a concealment means such as cap 16 having a top face 48. Shoulder 44 created by counterbore 42 creates an area on which nut 15 may engage.

Cap 16 may attach either to stud 14, nut 15, or to the protective cover 12 along counterbore 42. Cap 16 may include snap connector legs 17 which allow a "snap-on" connection to be made with either fastener passage 38 or to the fastener means. Once connected, cap 16 may not be removed without destroying cap 16 and snap connector legs 17. A feature for cap mean 16 is that, when attached, top face 48 is even and flush with front face 18 of cover 12 thereby making a flat front surface concealing the fastener means. For further concealment, a label or single sided adhesive tape may be placed over cap top face 48 to further prevent service personnel from access to fastener means.

Figure 6:
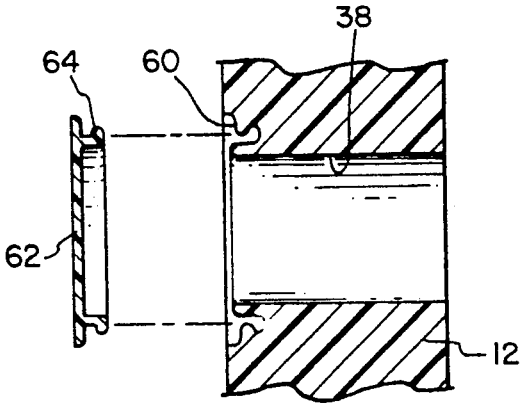
FIG. 6 is an alternate embodiment of the concealment means of the present invention.

In FIG. 6, an alternate concealment means 16 is shown in which fastener passage 38 includes a channel means 60 to permit cap 62 to be permanently snap-fit and attached to cover 12 by lug means 64. Alternate attachment methods may be used to permanently attach cap 62 to cover 12.

Concealment means 16 prevents field technicians from viewing how protective cover 12 is fastened to compressor housing 35. This lessens the chance of service personnel trying to remove protective cover assembly 10 and attaching a power source to hermetic terminal 33. If however, field technicians attempt to remove protective cover 12 from terminal 33, they will destroy protective cover 12.

In operation, permanent protective cover 12 attaches to compressor housing 13 by studs 14 and nuts 15. A hermetic terminal connector 31, embedded within cover 12, attaches to a hermetic terminal pin 39. The hermetic connector 31 is electrically connected by wires 34 to top mounted terminal strip 22. Terminal strip 22 allows electrical connection by field personnel to hermetic terminal cluster 33 without removal of protective cover 12.

The concealment means operates to prevent service personnel from removing cover 12 from housing 35 in two ways. The concealing means, such as cap 16, prevents service personnel from viewing the fastener means such as nut 15 and stud 14. Cap 16 also prohibits service personnel from unfastening cover 12 from housing 35 without destroying protective cover 12 in the process.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic compressor including a housing with a hermetic terminal cluster thereon and a protective cover assembly covering said hermetic terminal cluster, said cover assembly comprising:

a protective cover attached to said housing, said cover including a recess for enclosing said hermetic terminal cluster;

terminal means located on said cover for connecting power to said hermetic terminal cluster; and connection means disposed within said cover for electrically connecting said terminal means and said hermetic terminal cluster, whereby said hermetic terminal cluster is enclosed at all times while electrical connection to said hermetic terminal cluster is permitted.

2. The hermetic compressor of claim 1 in which said terminal means includes both male quick-connect terminals and screw type terminals.

3. The hermetic compressor of claim 1 in which said assembly further comprises a terminal cover attaching over said terminal means to said cover.

4. The hermetic compressor of claim 1 in which said cover is attached to said housing by a push nut slid on to a stud, said stud disposed through said protective cover and welded to said compressor.

5. The hermetic compressor of claim 4 further comprising a concealment means for concealing said push nut and stud.

6. The hermetic compressor of claim 5 in which said concealment means is a cap having a top face, said cap covering said push nut and stud so that said top face is flush with said protective cover.

7. The hermetic compressor of claim 1 in which said assembly further comprises a gasket disposed between said cover and said compressor housing.

8. The hermetic compressor of claim 7 in which said gasket is constructed from neoprene.

9. A hermetic compressor including a housing with a hermetic terminal cluster thereon, and a protective cover assembly covering said hermetic terminal cluster, said assembly comprising:

a protective cover having a front and rear face, said front face having a terminal strip, said rear face having a recess into which said hermetic terminal cluster may be received, a hermetic terminal connector disposed within said recess, said terminal strip and said terminal connector electrically connected;

a fastener attaching said protective cover to said housing, said protective cover fastened to said housing with said terminal connector attaching to said terminal cluster with said rear face of said protective cover adjacent said compressor; and concealment means for concealing said fastener from view whereby service personnel do not attempt to remove said protective cover from said housing.

10. The hermetic compressor of claim 9 in which said concealment means is a cap having a top, said cap covering said fastener so that said cap top is even with said front face.

11. The hermetic compressor of claim 10 in which said cap attaches to said fastener.

12. The hermetic compressor of claim 10 in which said cap attaches to said protective cover means.

13. A hermetic compressor having a hermetic terminal cluster thereon and a protective cover assembly over said hermetic terminal cluster, said assembly comprising:

a protective cover having a front and rear face, said front face having a terminal strip, said rear face having a recess including a hermetic terminal cluster connector therein, said terminal strip an said terminal connector electrically connected;

fastener means for attaching said protective cover to said hermetic compressor with said hermetic terminal cluster disposed within said recess and electrically connected to said terminal cluster connector;

a gasket disposed between said protective cover and said compressor; and concealment means for concealing said fastener means from view.

14. The hermetic compressor of claim 13 in which said concealment means comprises a cap having a top face, said cap covering said fastener so that said cap top face is even with said front face, whereby access to said fastener is prevented.

15. The hermetic compressor of claim 13 in which said gasket is constructed from neoprene.

16. The hermetic compressor of claim 13 in which said fastener is a nut attached to a stud, said stud disposed through said protective cover and welded to said compressor.

17. The hermetic compressor of claim 16 in which said terminal strip includes both male quick-connect terminals and screw type terminals.

18. The hermetic compressor of claim 17 in which said assembly further comprises a terminal cover attaching over said terminal strip to said protective cover by means of a screw.

* * * * *